US007651091B2

(12) United States Patent
McNally et al.

(10) Patent No.: US 7,651,091 B2
(45) Date of Patent: Jan. 26, 2010

(54) DIAPHRAGM

(75) Inventors: Stephen McNally, Vancouver, WA (US); Steve O. Rasmussen, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 550 days.

(21) Appl. No.: 11/256,769

(22) Filed: Oct. 24, 2005

(65) Prior Publication Data

US 2007/0090593 A1 Apr. 26, 2007

(51) Int. Cl.
*B65H 5/02* (2006.01)
*B65H 29/32* (2006.01)

(52) U.S. Cl. ..... 271/276; 271/196

(58) Field of Classification Search ..... 271/276, 271/196, 197, 108; 251/331, 61.1, 335.2, 251/334
See application file for complete search history.

(56) References Cited

U.S. PATENT DOCUMENTS

| | | | | |
|---|---|---|---|---|
| 4,202,542 | A * | 5/1980 | Lammers et al. | 271/276 |
| 4,381,893 | A | 5/1983 | Silverberg | |
| 4,382,593 | A | 5/1983 | Beran et al. | |
| 5,183,252 | A * | 2/1993 | Wolber et al. | 271/276 |
| 5,241,907 | A * | 9/1993 | Dorsam et al. | 101/409 |
| 5,329,301 | A * | 7/1994 | Balzeit et al. | 346/134 |
| 5,839,722 | A | 11/1998 | Berlin et al. | |
| 5,884,907 | A | 3/1999 | Ohkoda | |
| 6,254,090 | B1 | 7/2001 | Rhodes et al. | |
| 6,722,652 | B2 * | 4/2004 | Kobayashi et al. | 271/276 |

* cited by examiner

*Primary Examiner*—David H Bollinger

(57) ABSTRACT

Example embodiments of a diaphragm are shown and described.

20 Claims, 5 Drawing Sheets

DIAPHRAGM

BACKGROUND

Air pressure and air flow are parameters that may influence effectiveness of media hold down systems in some imaging devices. Amounts of available air pressure and air flow may be affected by the power and space available in the device. Use of valves to regulate the air flow within a media hold down system may result in pressure losses and associated decreased ability of the media hold down system to adequately hold down media.

DETAILED DESCRIPTION

Figure 1:
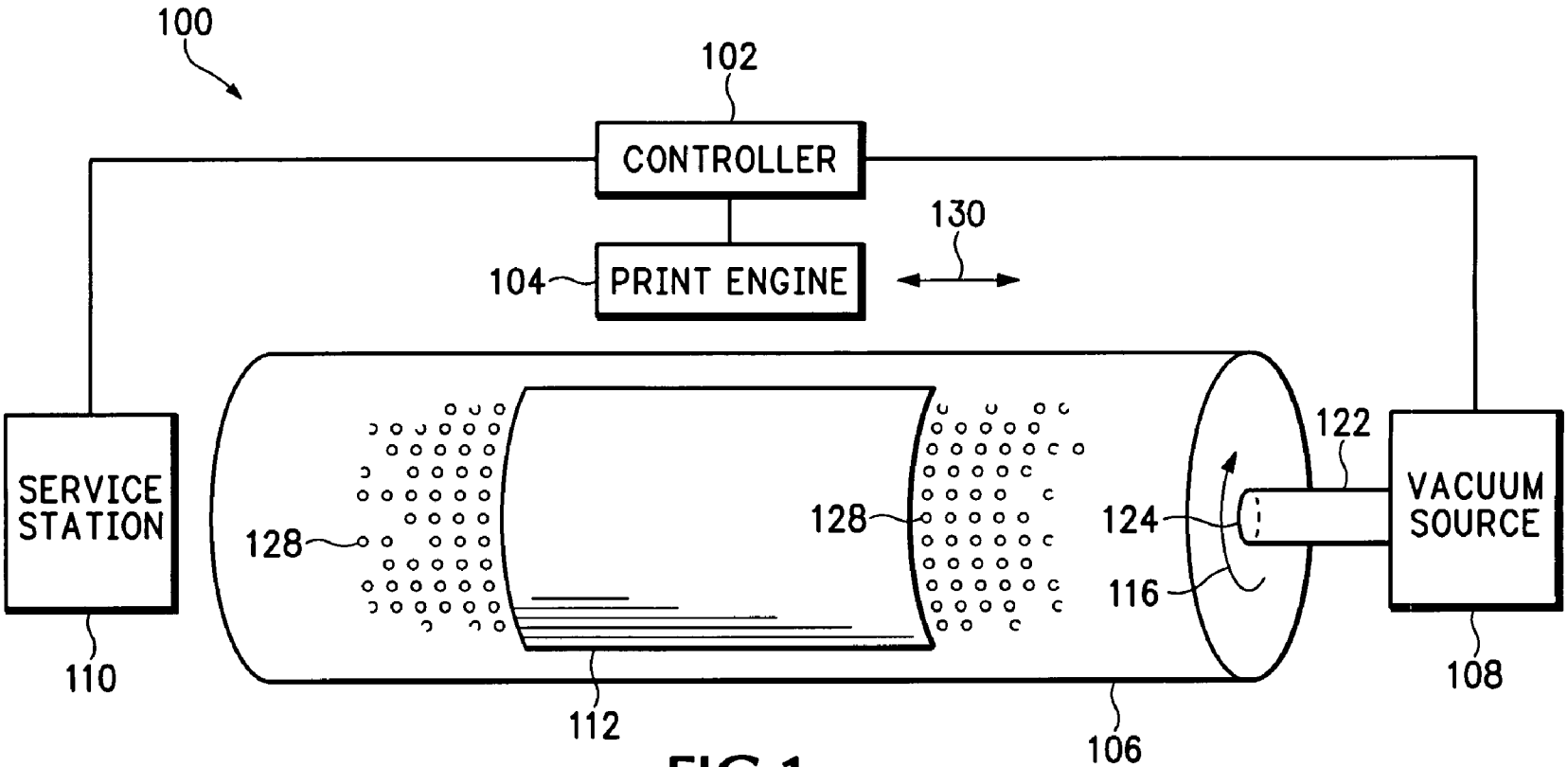
FIG. 1 illustrates an example imaging system in accordance with an example embodiment.

FIG. 1 illustrates an example imaging system 100 in accordance with an example embodiment. As shown, the imaging system 100 includes a controller 102, a print engine 104, a drum 106, a vacuum source 108, and a service station 110. In general, the print engine 104 is used to form an image on a medium 112 disposed on the drum 106 as the drum 106 rotates in direction 116.

The drum 106 comprises a platen configured to rotate in the direction 116 while supporting a medium, such as the medium 112. The vacuum source 108 is in fluid communication with an interior region of the drum 106 via conduit 122 and bearing 124. The drum 106 is also shown as including apertures 128 through which a vacuum induced flow of air may pass, under the influence of the vacuum source 108. The vacuum-induced flow creates a suction force that aids in holding the medium 112 to the drum 106.

The print engine 104 operates under control of the controller 102 to at least partially image the medium 112 as the medium 112 passes adjacent the print engine 104. In some embodiments, the print engine 104 may comprise an inkjet print engine. Pursuant to some embodiments, the print engine 104 may comprise a page wide array of fixed printheads that do not move during printing. In other embodiments, the print engine 104 may move in the directions 130 during printing. In other embodiments, the print engine 104 remains stationary during printing and moves in the directions 130 during servicing.

The print engine 104 may perform a servicing operation, such as one or more of spitting, wiping, and capping, by moving to a position adjacent the service station 110. In the example embodiment shown in FIG. 1, the service station 110 is shown as being positioned adjacent an end of the drum 106. In other embodiments, the service station 110 may be positioned within or on the drum 106. In other embodiments, the service station 110 may be omitted.

The controller 102 may comprise a processor configured to control one or more of the print engine 104, the service station 110, rotation of the drum 106 and the vacuum source 108. The controller 102 may also be configured to perform or control other functions of the system 100.

U.S. Pat. No. 6,254,090 discloses additional details regarding vacuum control for vacuum hold down and is incorporated herein by reference.

Figure 2:
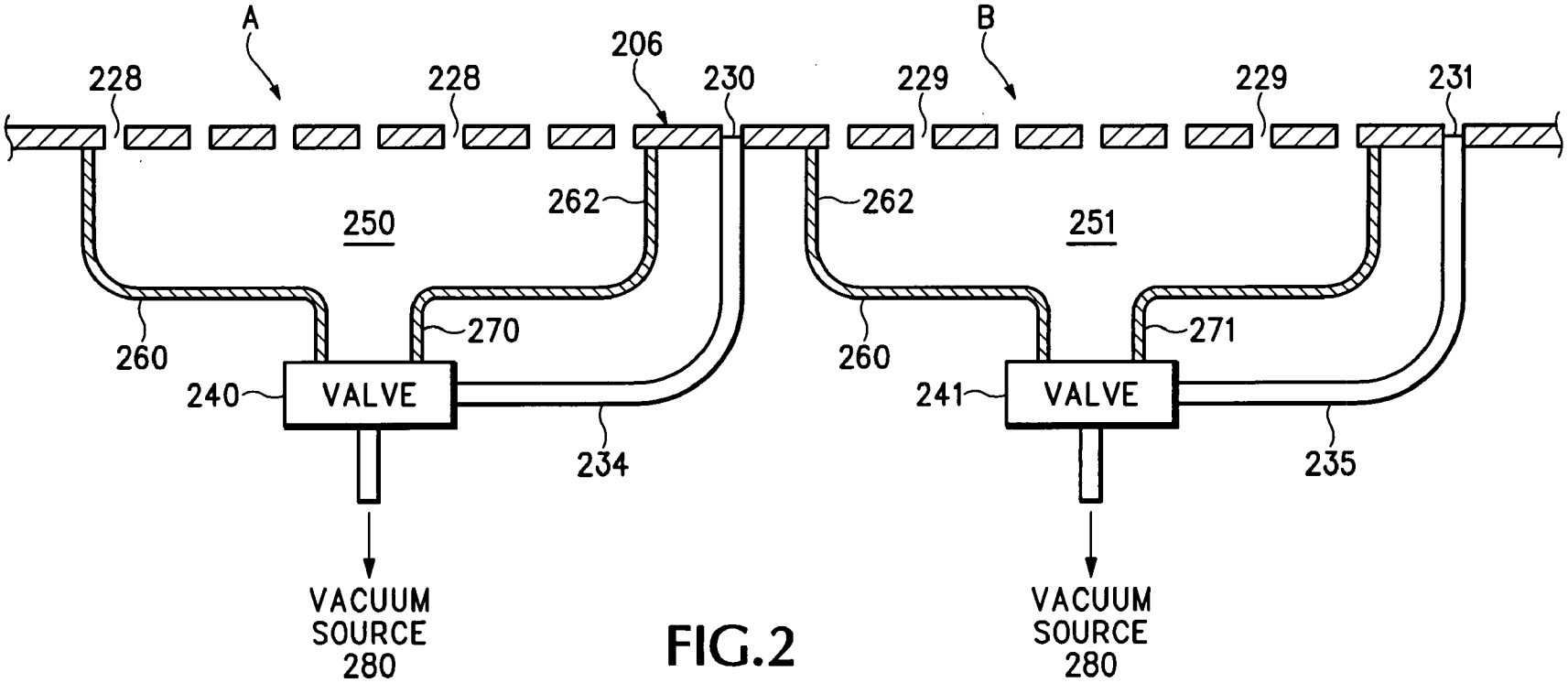
FIG. 2 illustrates an example sectional view of an example portion of an example embodiment of a platen according to an example embodiment.

FIG. 2 is a cross-sectional partially-schematic view of a portion of a platen 206 in accordance with an example embodiment. As shown, the platen 206 includes apertures 228 and 229. The apertures 228 and 229 are formed in sectors A and B, respectively, of the platen 206. Sector A is also shown as having an associated pilot hole 230. Sector B is also shown as having an associated pilot hole 231. The pilot holes 230, 231 are coupled to valves 240, 241 via conduits 234, 235 and serve as trigger ports for the valves 240, 241, respectively. The valves 240, 241 serve to selectively fluidly couple the apertures 228, 229, respectively, with a vacuum source 280. Air chambers 250, 251 are formed within one or more housings 260 and are separated by at least one wall 262.

The chambers 250, 251 respectively include outlets 270, 271 adjacent to valves 240, 241. The valves 240, 241 are operable to seal the corresponding one of the outlets 270, 271 according to whether the associated pilot hole 230, 231 is covered. When one of the pilot holes 230, 231 is covered, the associated valve 240, 241 opens. When one of the pilot holes 230, 231 is uncovered, the associated valve 240, 241 closes. Hence, the valves 240, 241 selectively fluidly couple the holes 228, 229 with the vacuum source 280 according to the covering of the pilot holes 230, 231.

The pilot holes 230, 231 may be covered by media on the platen 206. In this manner, before media is placed on the platen 206 over one or more of the pilot holes 230, 231, the valves 240, 241 seal the outlets 270, 271 to prevent or limit airflow through the apertures 228, 229 towards the vacuum source 280 via the valves 240, 241. When a sheet of media, however, is placed over the pilot hole 230, the pressure within the valve 240 drops and causes the valve 240 to open. In an open configuration, the valve 240 permits airflow from the apertures 228, toward the vacuum source 280 thereby creating a suction force at the platen 206 in sector A. Hence, the suction force is provided at one or more sectors of the platen 206 that have a corresponding pilot hole covered. If a pilot hole of an associated sector is not covered, suction force is not provided to the platen within that sector. Consequently, in this configuration, suction force is provided to sectors having covered pilot holes and is not typically provided to sectors having open pilot holes. Details of example configurations for the valves 240, 241 are described below.

Figure 3:
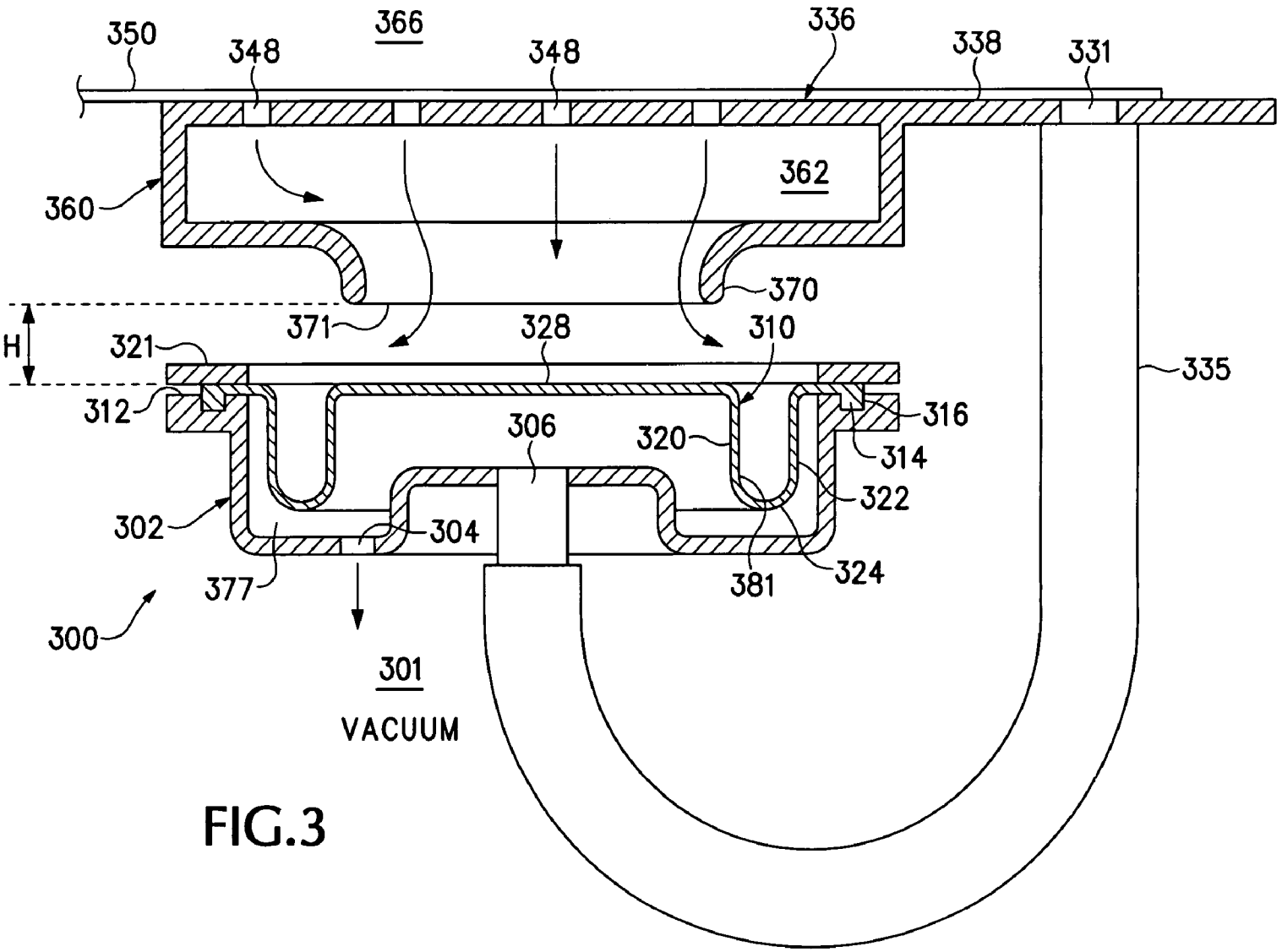
FIG. 3 illustrates an example valve in an example open position according to an example embodiment.

FIG. 3 illustrates an example embodiment of a valve system 300 in an open position. The valve system 300 includes a valve housing 302 having vacuum port 304 and pilot port 306. A diaphragm 310 is on a top surface 312 of the valve housing 302. In the embodiment illustrated in FIG. 3, the diaphragm 310 is shown as including an annular flange 314 sized to fit within annular groove 316 formed in the valve housing 302 for facilitating positioning the diaphragm 310 on the valve housing 302. A ring 321 is positioned about a perimeter of the diaphragm 310 to maintain the perimeter of the diaphragm 310 in tight contact with the housing 302. Fasteners (not shown) or other suitable means may be used to secure the ring 321 to the housing 302.

The diaphragm 310 shown in FIG. 3 comprises a rolling diaphragm. In particular, the diaphragm 310 is illustrated as having inner and outer annular walls 320, 322. The inner and outer annular walls 320, 322 are substantially parallel to each other and concentric. Moreover the inner and outer annular walls 320, 322 are joined by a rounded portion 324. In some applications, the annular walls 320, 322 and the rounded portion 324 may be collectively referred to as a "convolution."

The diaphragm 310 further includes a seat 328. The seat 328 is a portion of the diaphragm 310 that is oriented substantially perpendicular to the inner and outer annular walls 320, 322. The seat 328 in FIG. 3 is circular and has a perimeter along a top edge of the inner annular wall 320. The diaphragm 310 may be formed of EPDM (Ethylene Propylene Diene Monomer) or of another suitable material. In some embodiments, the material thickness at the seat 328 is about twice the thickness of the diaphragm material at the annular walls 320, 322. According to some embodiments, the annular walls have a thickness less than about 60% of the thickness of the seat 328. In one embodiment, the seat 328 has a thickness of about 1 mm and the annular walls 320, 322 have a thickness of about 0.5 mm. Pursuant to other embodiments, the relative thickness of the seat 320 and the annular walls 320, 322 may be of a different ratio. The overall height of the diaphragm 310 may be about 11 mm in some embodiments. Different embodiments may, of course, employ different dimensions.

A platen 336 is provided for supporting one or more sheets of media on a top surface 338 thereof. In this example embodiment, the platen 336 comprises a drum, the interior 301 of which is fluidly coupled to a vacuum source, such as the vacuum source 108 shown in FIG. 1. As illustrated in FIG. 3, the platen 336 includes apertures 348 and pilot hole 331. The platen 336 may be formed of aluminum or other suitable material.

A conduit 335 fluidly couples the pilot hole 331 and the pilot port 306. As illustrated in FIG. 3, the conduit 335 may comprise a flexible hollow tube that interconnects the pilot hole 331 and the pilot port 306. When the pilot hole 331 is uncovered (FIG. 4), the conduit 335 provides atmospheric pressure at the pilot port 306. When the pilot hole 331 is covered (FIG. 3), such as by a sheet of media 350, the conduit 335 provides a pressure substantially less than atmospheric pressure at the pilot port 306.

A manifold 360 is positioned adjacent the platen 336 and includes chamber 362. The apertures 348 are in fluid communication with the chamber 362. Further, the manifold 360 also includes an outlet 370. Hence, when the system 300 is positioned in the open position shown in FIG. 3, air from outside 366 the platen 336 is drawn through the apertures 348, through the chamber 362, and through the outlet 370 into an interior 301 of the platen 336 towards a vacuum source. This airflow at the platen 336 creates a suction force that aids in holding the media 350 at the platen 336.

In the example embodiment the port 306 is larger than the port 304. For example, in embodiments where the cross-sectional shapes of the ports 304 and 306 are circular, the port 306 has a cross-sectional diameter about twice as large as a cross-sectional diameter of the port 304. Pursuant to some embodiments, the cross-sectional area of the port 306 is about four times the cross-sectional area of the port 304. Adjusting the relative sizes of the ports 304, 306 may result in changes to response time for the valve. This response time is the time during which the diaphragm 310 moves between the positions shown in FIGS. 3 and 4 in response to a change in pressure differential across the ports 304, 306.

In the open position shown in FIG. 3, the pressure in the housing interior 377 is substantially less than atmospheric pressure, which results in the seat 328 being positioned in the lowered position shown in FIG. 3. Pursuant to some embodiments, the pressure within the housing interior 377 is about the pressure of the interior 301 of the platen 336.

A distance H separates the seat 328 in FIG. 3 and a bottom surface 371 of the outlet 370. The distance H, in some embodiments, is the height of the flow path though which the air passes between the manifold bottom surface 371 and the seat 328. The distance H, in some embodiments, is the distance through which the seat 328 travels as the seat 328 moves between the open position shown in FIG. 3 and the closed position shown in FIG. 4. Pursuant to some configurations, increasing the magnitude of the distance H decreases a pressure loss through the valve. The diaphragm 310 rolls at or along the convolution as the diaphragm 310 moves between the positions shown in FIGS. 3 and 4.

Figure 4:
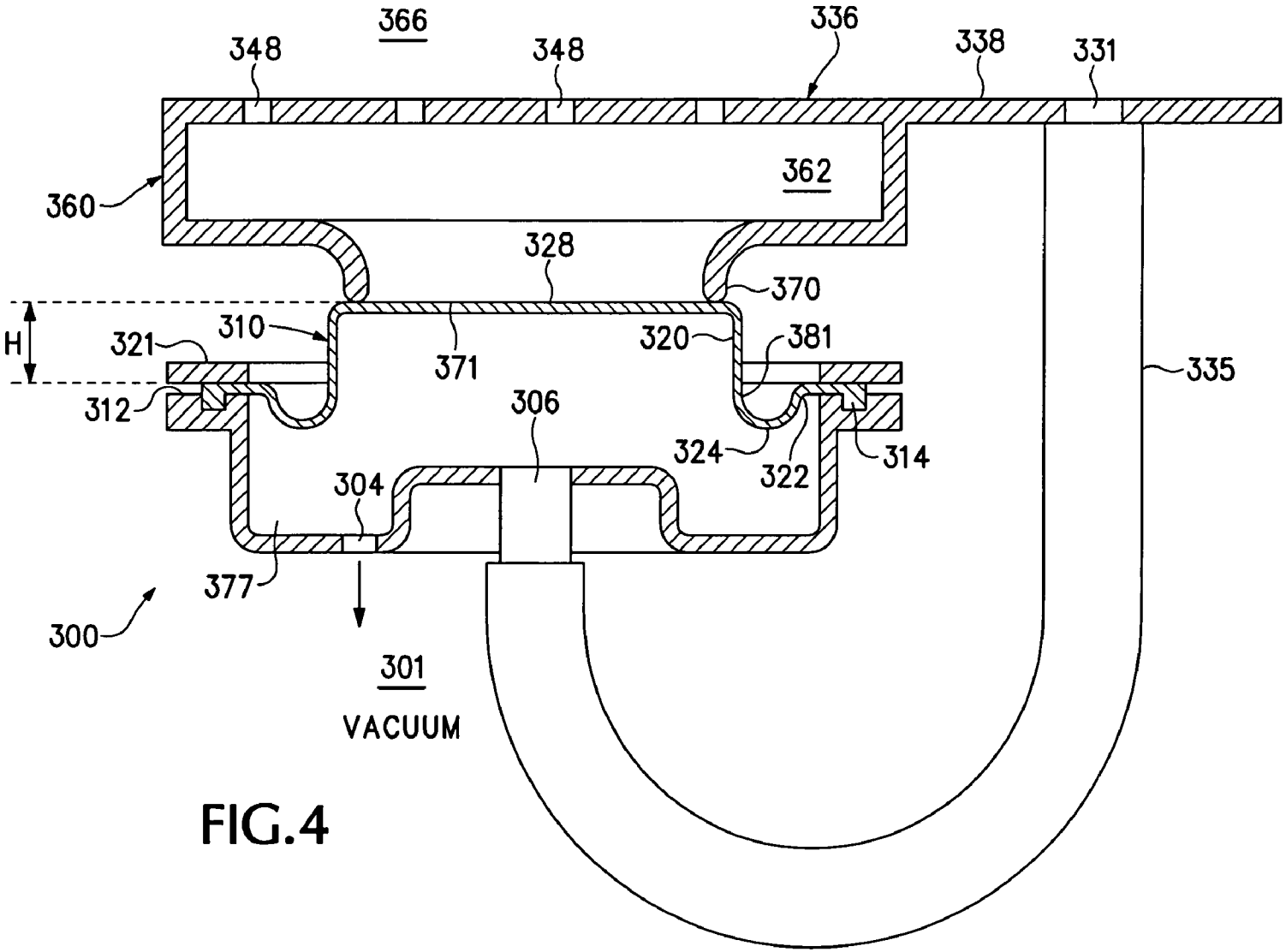
FIG. 4 illustrates the example valve of FIG. 3 in an example closed position according to an example embodiment.

FIG. 4 illustrates the valve system 300 in a closed position. As shown, FIG. 4 shows a configuration that is the same as the configuration shown in FIG. 3, except the position and shape of the diaphragm 310 and the uncovered status of the pilot hole 331.

In the closed position shown in FIG. 4, the pressure in the housing interior 377 is substantially equal to or slightly less than atmospheric pressure, which results in the seat 328 being positioned in the raised position shown in FIG. 3.

In operation, before a sheet of media is placed over the pilot hole 331 on the surface 338 of the platen 336, the diaphragm 310 is in the closed position shown in FIG. 4. In the closed position, the pressure within the housing interior 377 is significantly greater than the pressure of the platen interior 301. The pressure within the housing interior 377 when the pilot hole 331 is uncovered is about or slightly less than atmospheric pressure. A pressure differential therefore exists between the housing interior 377 and the platen interior 301. This air pressure differential moves, or maintains, the seat 328 of the diaphragm 310 in the raised position shown in FIG. 4. In FIG. 4, the seat 328 is in contact with the bottom surface 371 of the outlet 370 and prevents, or significantly reduces, air flow through the outlet 370 into the interior of the platen 336.

Pursuant to some embodiments, the seat 328 of the diaphragm 310 is not significantly stretched or deformed as the seat 328 moves from the unstressed shape shown in FIG. 3 to the position shown in FIG. 4. Rather, the seat 328 remains substantially planar and does not significantly deform as a result of the pressure differential. The pressure differential instead causes at least a portion of the material of the annular walls 320, 322 to roll through the curved portion 324. As a result, a reference point 381 is shown as moving from annular wall 322 in FIG. 3 to annular wall 324 in FIG. 4 due to moving through the portion 324.

When a sheet of media covers the hole 331, the pressure within the housing interior 377 decreases. The pressure within the housing interior 377, in some embodiments, decreases to about the same pressure as the interior 301 of the platen 336. This reduction in pressure in the housing interior 377 substantially removes a net air pressure force on the seat 328. Consequently, without a significant pressure differential across the seat 328, the seat 328 returns to the nominal position shown in FIG. 3.

Pursuant to some embodiments, use of a rolling diaphragm as described herein permits a satisfactorily large distance H though which the seat 328 moves to be employed. Increasing the distance H may result in lowering pressure losses in the valve system. Further, because the seat 328 is not subject, in some embodiments, to significant tensile stresses, the life of the seat 328 may be longer than if the seat 328 were subject to significant and repeated stresses.

Figure 5:
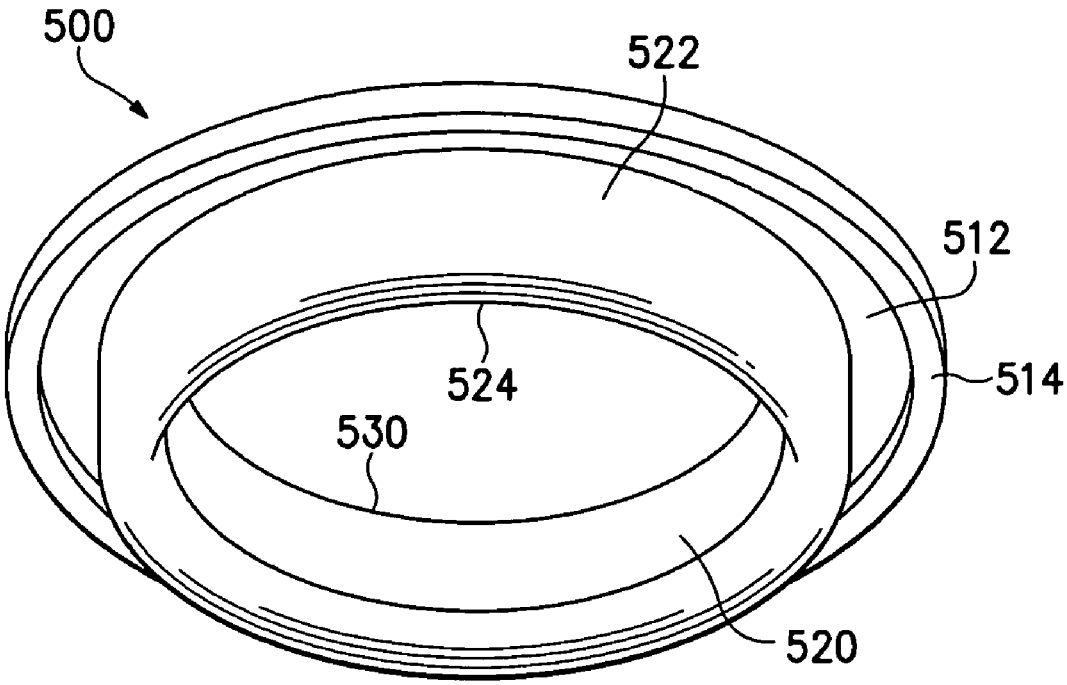
FIG. 5 illustrates a bottom perspective view of an example diaphragm according to an example embodiment.
Figure 6:
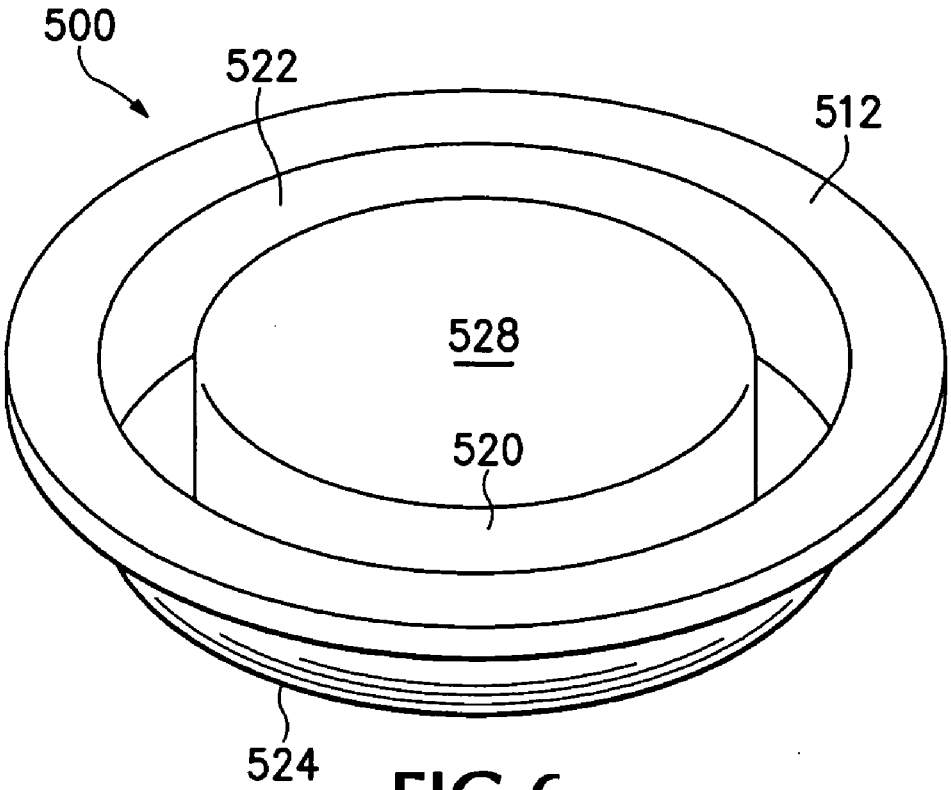
FIG. 6 illustrates a top perspective view of an example diaphragm according to an example embodiment.

FIGS. 5 and 6 illustrate bottom and top perspective views, respectively, of an example diaphragm 500 according to an example embodiment. As shown, the example diaphragm 500 includes inner and outer annular walls 520, 522 joined by a rounded portion 524. A seat 528 is positioned within the inner annular wall 520. A flange 514 is formed on rim 512. The inner wall 520 and the seat 528 intersect along circular corner 530.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A media hold down system, comprising:

a drum for holding media on a surface thereof, the drum having an interior coupled to a vacuum source;

vacuum-operated valves within the drum;

the vacuum-operated valves each having a diaphragm;

each diaphragm having annular walls.

2. The media hold down system of claim 1, wherein the annular walls are parallel to each other, each diaphragm having a seat orthogonal to the annular walls.

3. The media hold down system of claim 1, wherein respective heights of the annular walls varies according to a pressure differential across the diaphragm.

4. The media hold down system of claim 1, wherein each diaphragm further comprises a circular seat disposed within and concentric with the annular walls, the circular seat orthogonal to the annular walls.

5. The media hold down system of claim 1, wherein each diaphragm is mounted on a housing having first and second ports, the first port in fluid communication with the vacuum source, the second port in fluid communication with an exterior surface of the drum.

6. The media hold down system of claim 1, wherein the diaphragm moves between open and closed positions without stretching.

7. The media hold down system of claim 1, wherein each diaphragm further comprises a seat disposed within and concentric with the annular walls, the seat orthogonal to the annular walls, the annular walls thinner than the seat.

8. The media hold down system of claim 1, wherein each diaphragm further comprises a circular seat disposed within and concentric with the annular walls, the circular seat orthogonal to the annular walls, the annular walls having a thickness less than 60% of a thickness of the circular seat.

9. The media hold down system of claim 1, when the drum includes apertures in communication with an inlet and wherein each vacuum-operated valve comprises:

a housing having a chamber fluidly coupled to first and second ports, wherein the diaphragm has a surface exposed to the chamber such that the diaphragm is configured to block the inlet in response to an air pressure differential between the first second ports.

10. The media hold down system of claim 1, wherein the drum includes apertures and wherein each vacuum-operated valve comprises:

a manifold in fluid communication with the apertures, the manifold including an outlet; and a housing supporting the diaphragm, wherein the diaphragm moves into and out of contact with the outlet.

11. An apparatus, comprising:

a platen having apertures;

a manifold in fluid communication with the apertures, the manifold including an outlet;

a housing having a diaphragm mounted thereon, the diaphragm configured to move into and out of contact with the outlet of the manifold by rolling.

12. The apparatus of claim 11, wherein the housing has a chamber fluidly coupled to a first port and a second port, wherein the diaphragm has a surface exposed the chamber such that the diaphragm is configured to block the outlet in response to an air pressure differential between the first port and the second port.

13. The apparatus of claim 12, wherein the first port is larger than the second port.

14. The apparatus of claim 12, wherein the diaphragm includes a pair of concentric annular walls and wherein a height of each of the concentric annular walls changes in response to a magnitude of the air pressure differential between the first port and the second port.

15. The apparatus of claim 14, wherein the diaphragm further comprises a seat portion within an inner perimeter of the pair of concentric annular walls, the seat having a circular flat surface that moves toward and away from the inlet in response to changes in the air pressure differential.

16. The apparatus of claim 12, wherein the apertures fluidly couple an outer surface of the platen with the outlet and wherein apparatus further comprises a hole formed in the platen and fluidly coupled to the first port.

17. The apparatus of claim 11, further comprising a print engine adjacent the platen.

18. An apparatus, comprising:

a platen having apertures;

a manifold in fluid communication with the apertures, the manifold including an outlet;

means for moving into and out of contact with the outlet of the manifold by rolling.

19. The apparatus of claim 11, wherein the diaphragm comprises an inner annular wall and an outer annular wall parallel to the inner annular wall and joined to the inner annular wall by a rounded portion.

20. The apparatus of claim 19, wherein the diaphragm comprises a seat having a circular perimeter at the inner annular wall.

* * * * *

UNITED STATES PATENT AND TRADEMARK OFFICE

CERTIFICATE OF CORRECTION

PATENT NO. : 7,651,091 B2
APPLICATION NO. : 11/256769
DATED : January 26, 2010
INVENTOR(S) : Stephen McNally et al.

It is certified that error appears in the above-identified patent and that said Letters Patent is hereby corrected as shown below:

In column 6, line 25, in Claim 12, after "exposed" insert -- to --.

Signed and Sealed this

Sixth Day of July, 2010

David J. Kappos

David J. Kappos
*Director of the United States Patent and Trademark Office*